United States Patent [19]

Darnell et al.

[11] Patent Number: 5,056,619

[45] Date of Patent: Oct. 15, 1991

[54] CONTROLLED DESCENT DEVICE

[76] Inventors: George Darnell, P.O. Box 589, Bokeelia, Fla. 33922; John E. Darnell, 2026 Garrison St., Walla Walla, Wash. 99362

[21] Appl. No.: 457,259

[22] Filed: Dec. 27, 1989

[51] Int. Cl.[5] ..... A62B 1/02; A62B 35/00

[52] U.S. Cl. ..... 182/5; 182/191

[58] Field of Search ..... 182/3, 5, 6, 7, 48, 182/82, 141, 187, 191; 187/25, 24

[56] References Cited

U.S. PATENT DOCUMENTS

| | | | |
|---|---|---|---|
| 87,143 | 2/1869 | Chamberlain | 187/25 |
| 647,980 | 4/1900 | Morrison et al. | 187/25 |
| 661,716 | 11/1900 | Gary | 187/25 |
| 1,026,650 | 5/1912 | Bloom | 187/25 |
| 1,161,255 | 11/1915 | Schnitzer | 187/25 |
| 2,970,523 | 2/1961 | Schurger | 187/25 |
| 3,944,021 | 3/1976 | Smith | 182/3 |

*Primary Examiner*—Reinaldo P. Machado
*Attorney, Agent, or Firm*—William E. Noonan

[57] ABSTRACT

A controlled descent device is disclosed, including an elongate guide assembly that has an upper portion, a lower portion and a generally helical track that extends from the upper portion to the lower portion. A carriage includes a primary bearing that is engaged with and movable within the track. A harness is secured to the carriage and the carriage is descendible along the track to lower a person fastened in the harness from the upper portion of the guide assembly to the lower portion thereof.

18 Claims, 6 Drawing Sheets

CONTROLLED DESCENT DEVICE

FIELD OF INVENTION

This invention relates to a controlled descent device and more particularly, to an apparatus which allows a person to descend to the earth in a controlled manner from, for example, a high rise building during a fire or other emergency, or from a helicopter hovering above the earth. Optional motorized ascent may also be provided.

BACKGROUND OF INVENTION

Modern high rise buildings very often do not provide ample means for escaping a fire, earthquake or other emergency affecting the upper floors. Stairwells, elevators and exits may be blocked, engulfed in flames or malfunctioning. Traditional skeletal stairway fire escapes have been eliminated from most modern high rise buildings. Other known methods of emergency escape, such as extendable ladders and safety nets are of limited effectiveness in most modern buildings. The use of such devices is limited to only a few lower floors.

For buildings that exceed 10 stories, airborne rescue by helicopter is often the only available means of escape from the higher floors. However, helicopter rescues are not only expensive, they are very often quite dangerous. The roof of the building may be incapable of sustaining the weight of the helicopter and many logistical problems may accompany the landing of the craft and the rescuing of persons from the building. The number of persons that can be accommodated in a single helicopter is limited and multiple helicopters can interfere with one another and may even risk the danger of colliding in an emergency situation.

As indicated, elevator escape may be unavailable if the elevator is blocked or malfunctioning. Moreover, each elevator is likely to have only a limited amount of space. Retrofitting buildings to include multiple elevators would likely be unduly expensive and architecturally suspect.

At least one city's fire department has trained fire fighters to rescue individuals by repelling down the sides of the building using ropes and other gear previously used in mountain climbing. This technique presents its own difficulties and dangers and obviously is quite limited in the number of persons that can be quickly and safely rescued.

The problems of controlled descent are not limited to high rise buildings. For example, emergency and military personnel are often required to disembark from a helicopter while the craft remains hovering above the earth. Subsequently, these or other persons may have to be hoisted back into the helicopter. Typically, each individual travels along a metallic cable which extends from the craft to the earth. Unfortunately, this cable can effectively act as a grounding device. During stormy or inclement weather, lightning or an electrical discharge can be instantaneously conducted along the cable, thereby creating a severe risk of injury to personnel.

SUMMARY OF THE INVENTION

It is therefore an object of this invention to provide a controlled descent device which allows persons to descend from buildings, helicopters and other heights in a safe, controlled manner.

It is a further object of this invention to provide such a device wherein the speed of travel may be conveniently and automatically controlled.

It is a further object of this invention to provide such a device which may be rapidly, conveniently and safely deployed in emergency situations.

It is a further object of this invention to provide such a device which may be readily disassembled and transported to required locations.

It is a further object of this invention to provide such a device which utilizes lightweight, yet rugged materials of construction.

It is a further object of this invention to provide a controlled ascent/descent device which provides for safe and reliable hoisting or lifting of persons and which is particularly effective for use as an elevator system.

This invention features a controlled descent device that includes an elongate guide assembly having an upper portion, a lower portion and a generally helical track which extends from the upper portion to the lower portion. There is a carriage which includes primary bearing means that are engaged with and movable within the track. There may be means for securing a harness to the carriage. The carriage is descendible along the track to lower a person fastened in the harness from the upper portion of the guide assembly to the lower portion thereof.

In a preferred embodiment, the guide assembly includes a plurality of alignable track segments and means for interengaging adjacent track segments in an end to end arrangement. The means for interengaging adjacent segments may include key means in one of the segments and complementary keyway means in the opposite end of the adjacent segment for receiving the key means. The key means and the keyway means may include complementary, generally cross-like shapes.

The guide assembly may include cable means extending longitudinally therethrough such that the helical track generally winds about the cable means. The guide assembly may include channel means formed longitudinally therethrough for accommodating the cable means. Stop means may be connected to the guide assembly proximate the lower portion to limit descent of the carriage along that assembly. Means may be provided proximate the upper portion for securing the guide assembly to a fixed structure.

The carriage may include an inner part that carries the primary bearing means and an outer part that is rotatably mounted to the inner part for carrying the means for securing. The carriage means may include secondary bearing means for rotatably interconnecting the inner and outer parts. The primary bearing means may include thread means formed along an inner surface of the carriage. Alternatively, the bearing means may include ball bearings enclosed by the carriage and received by the track.

The means for securing may include at least one hitching element fixed to the carriage. A complementary hook element may be attached to the harness and selectively engaged with the hitching element to secure the harness with the carriage.

A controlled ascent device is also disclosed. Preferably this device includes means for axially rotating the guide assembly in a predetermined direction so that the carriage is raised along the track. By rotating the guide assembly in the opposite direction the carriage is lowered.

BRIEF DESCRIPTION OF THE DRAWINGS

Other objects, feature and advantages will occur from the following description of a preferred embodiment and the accompanying drawings in which.

DETAILED DESCRIPTION OF PREFERRED EMBODIMENTS

Figure 1:
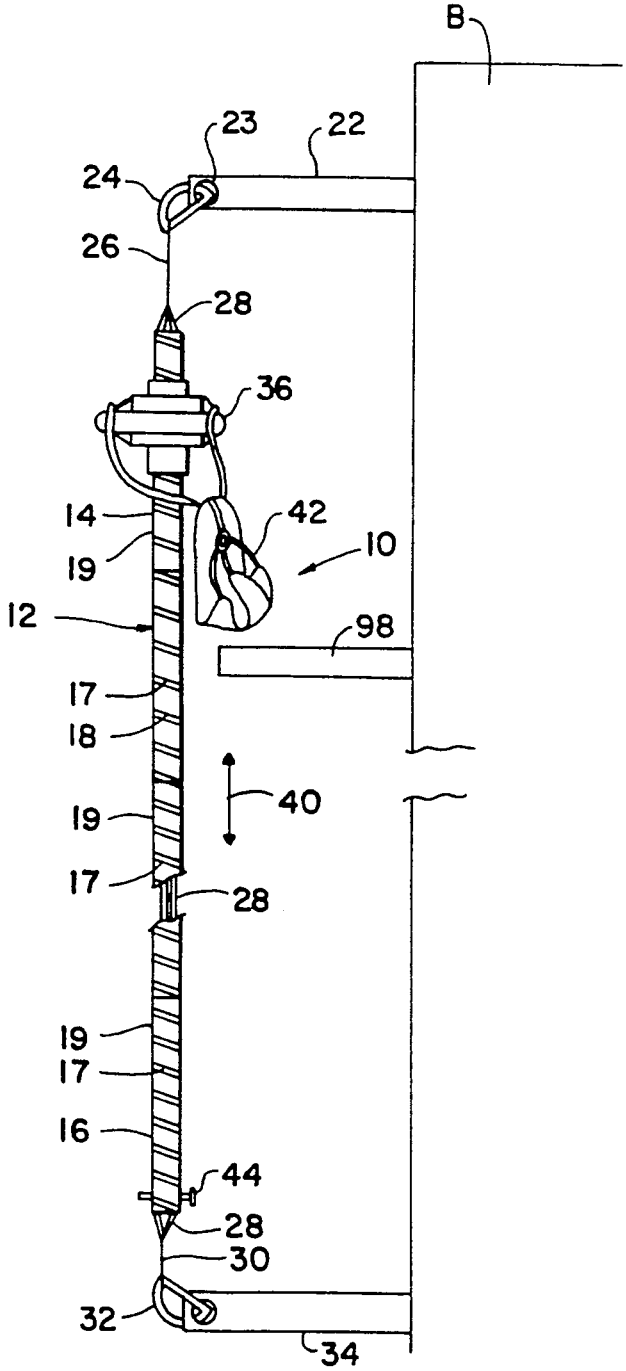
FIG. 1 is an elevational, partially cut away view of a controlled descent device according to this invention.

There is shown in FIG. 1 a controlled descent device 10 that includes an elongate, preferably cylindrical guide assembly 12. Guide assembly 12 includes an upper portion 14 that is positioned proximate the height from which descent is desired and a lower portion 16 that is positioned proximate the destination desired. In FIG. 1, device 10 is used for descent from a high rise building B. In alternative embodiments, the device may be utilized with aircraft, such as helicopters and for other objects from which descent is desired. More particularly, guide assembly 12 includes a plurality of alignable segments 19 that are interengaged in an end to end arrangement, as described more fully below. A helical track 17 is formed circumferentially about each guide segment 19. When the individual segments 19 are joined to form guide assembly 12, the tracks 17 formed in the respective segments align so that a continuous helical track 18 is formed from the upper portion 14 to the lower portion 16 of the guide assembly.

Guide assembly 12 is secured to a support 22 extending from building B by means of a conventional clamp 24 that engages an opening 23 in support 22. Clamp 24 is carried at the end of a cable 26. Cable 26 diverges into four strands 28, which extend through guide assembly 12, generally from the upper portion 14 to the lower portion 16. Strands 28 then merge below the bottom of the guide assembly 12 into a lower cable 30. A clamp 32, carried at the lower end of cable 30, attaches in a similar manner to a lower support 34 such that the lower end of device 10 is held in place. Clamps 24 and 32 may be reversed so that, if needed, device 10 may be mounted in the reverse direction. Thus, in a multiple story building, clamp 32 may serve as the upper clamp and the device 10 may be suspended to the next lower floor without disattaching clamp 32. Portion 14 now becomes the lower portion and clamp 24 is attached at the lower floor.

A carriage 36 is operably mounted to guide assembly 12. The carriage engages track 18 in a manner described more fully below, such that the carriage is allowed to move up and down the guide assembly in the direction of double headed arrow 40. A harness 42 for accommodating a person is secured to carriage 36, again in a manner described more fully below. In alternative embodiments the carriage may comprise other means, such as platforms and handles, for supporting persons. A stop element 44 is mounted through guide assembly 12 so that the descent of carriage 36 is stopped proximate the lower portion 16 of the guide assembly.

Figure 2:
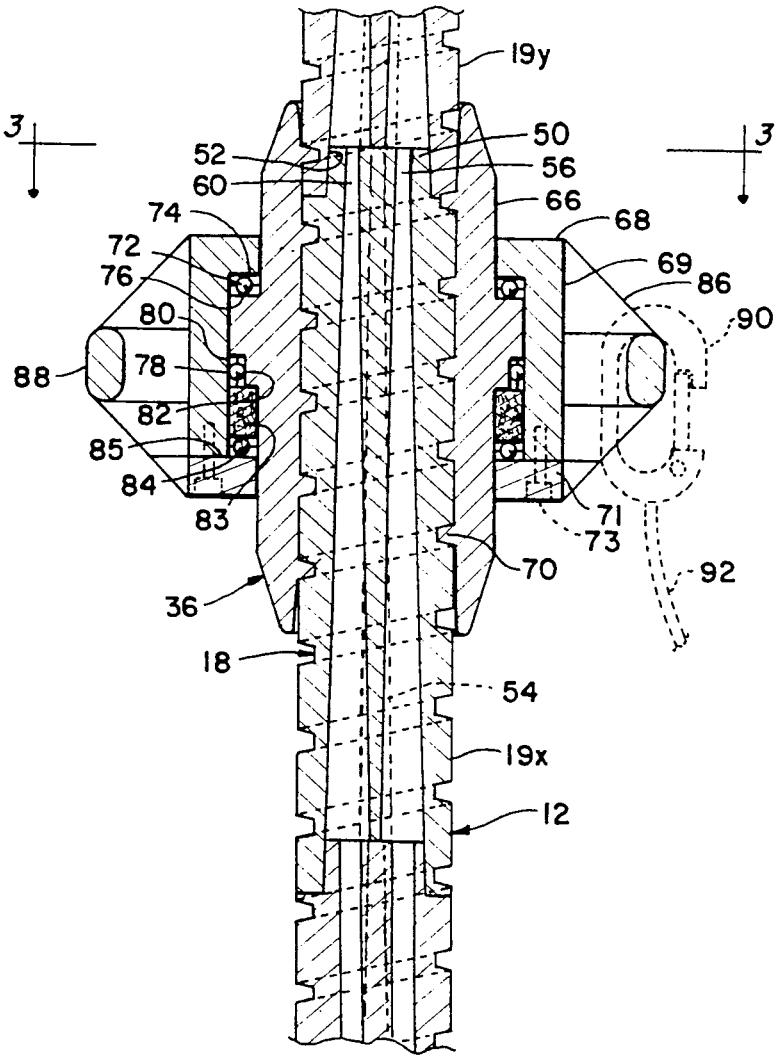
FIG. 2 is an elevational, cross sectional view of a portion of the guide assembly and the carriage, which is engagable with the guide assembly.
Figure 3:
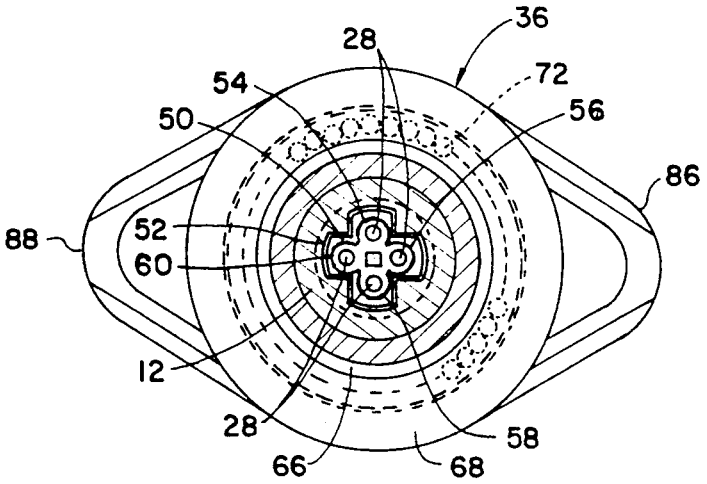
FIG. 3 is a cross sectional view taken along line 3—3 of FIG. 2.

As shown in FIGS. 2 and 3, each guide segment is selectively engaged with one or more adjacent segments by a complementary tapered key and keyway construction. More particularly, segment 19*x* includes a generally cross or X-shaped key 50 that extends axially upwardly from the upper end of the guide segment 19*x*. The lower end of the upper segment 19*y* includes a complementary keyway opening 52 that has a similar cross or X-shape. Keyway 52 receives key 50 so that the adjacent segments 19*x* and 19*y* interengage and lock. Each of the segments interconnect in this manner.

Four channels 54, 56, 58 and 60 are formed longitudinally through each guide segment 19. Each of the four channels is preferably tapered from the upper end to the lower end of each segment 19. Each extends through segment 19 between respective arms in key 50 and keyway 52. When all of the guide segments of the guide assembly 12 are interengaged, the respective channels 54 through 60 are aligned so that four elongate channels are formed through the entire guide assembly for accommodating respective strands 28. In FIG. 2, only three channels are shown and the strands are omitted for clarity.

Preferably, each segment of guide assembly 12 is composed of a rugged, yet very durable plastic. Alternatively, various metals and other materials may be utilized for the guide assembly. The guide assembly may be constructed by various known methods such as injection molding or machining. The angle of the helical track 18 may be varied to provide differing descent speeds. A preferred angle is approximately 15 degrees.

Carriage 36, FIGS. 2 and 3, includes an inner part 66 and an outer part 68. Both parts are preferably composed of a plastic material, although other materials may be utilized. Inner part 66 surrounds guide assembly 12 and includes primary bearing means for engaging track 18. Such bearing means include a generally helical thread 70 that is formed along an elongate central opening of inner part 66. Thread 70 is received within track 18 and slides in the track so that inner part 66 moves rotatably in a helical fashion up and down guide assembly 12. In alternative embodiments, various other types of bearing means may be employed for engaging inner part 66 with track 18. Such means may include ball bearings, teeth and other such elements.

Outer part 68 of carriage 36 includes a generally annular structure 69 which surrounds inner part 66, and a plate 71 which is fastened to structure 69 by bolts 73. A plurality of secondary bearing means rotatably interconnect outer part 68 and inner part 66. More particularly, a ring of ball bearings 72 interengage surface 74 of outer part 68 and surface 76 of inner part 66. Ball bearings 78 similarly interengage surface 80 of outer part 68 and surface 82 of inner part 66. A fiber ring 83 surrounds inner part 66 below bearings 78. A third set of ball bearings 84 interengage fiber ring 83 and surface 85 of outer part 68. These three sets of ball bearings allow outer part 68 to rotate freely relative to 66. Therefore, as carriage 36 descends track 18, inner part 66 rotates about guide assembly 12 while outer part 68 remains oriented in a constant direction and does not rotate.

Outer part 68 further includes a pair of hitching elements 86 and 88 which extend outwardly therefrom. Each hitching element is engaged by a respective clamp 90 which is connected to harness 42, FIG. 1, by a strap 92.

In operation, device 10 is deployed on building B, FIG. 1, by opening clamp 24 and attaching the guide assembly 12 through the hole in support 22. Carriage 36 is engaged with track 18 of assembly 12, either before the assembly is attached to support 22 or after such attachment is made. In the latter case, the carriage may be provided with a hinge-like construction so that it may be selectively opened and then closed to clamp around the guide assembly. In either case, the person wishing to descend the device leaves building B by ledge 98 and fastens himself to harness 42. The person then steps away from ledge 98. The weight of that person drives carriage 36 downwardly along the guide assembly such that thread 70 descends along track 18. Because the angle of the helical track 18 is predetermined and limited, for example, to approximately 15 degrees, the speed of descent is controlled so that the person is not traveling too rapidly when the carriage engages stop 44. Because the inner and outer parts 66 and 68 of carriage 36 are rotatably connected, the outer part 68 does not rotate relative to guide assembly 12 and the person remains facing one direction during the entire descent. Upon reaching the bottom of guide assembly 12, the person releases himself from the harness and departs either along a ledge or the ground.

Figure 4:
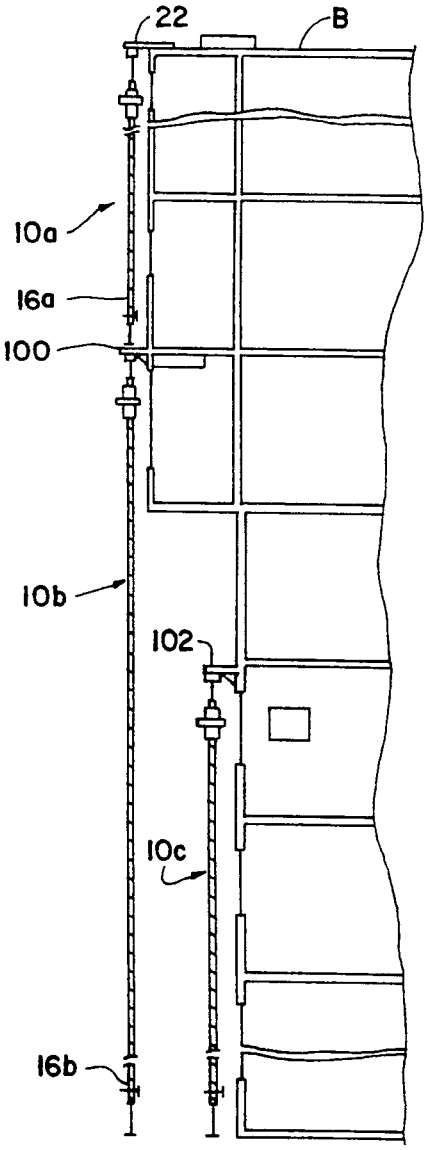
FIG. 4 is an elevational view of the side of a building with various descent devices deployed therefrom.

Device 10 may be mounted to a high rise in a variety of arrangements, as shown in FIG. 4. More particularly, one device 10*a* is deployed from a support 22 on the roof of the building B. The lower portion 16*a* of device 10*a* is positioned proximate a ledge 100 of a lower floor. A second descent device 10*b* is then attached from a support on ledge 100 and that device extends to a lower portion 16*b*, which is positioned proximate the ground. This arrangement allows the person to descend the building in stages.

Lower descent device 10*b* extends all the way to the ground because the building B juts outwardly and the lower floors do not have a ledge or support to which the person descending along device 10*b* can transfer. Accordingly, a third descent device 10*c* is mounted to a support on ledge 102, which extends from the lower floor beneath the overhang of building B. Device 10*c* descends therefrom to the ground. Similar arrangements of descent devices may be employed for the other floors of the building.

Figure 5A:
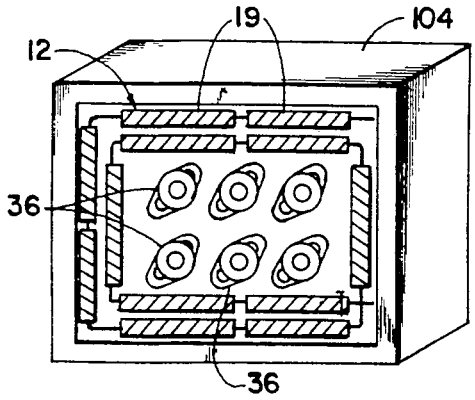
FIG. 5A is an isometric view of a case for carrying the controlled descent device to a required site.
Figure 5B:
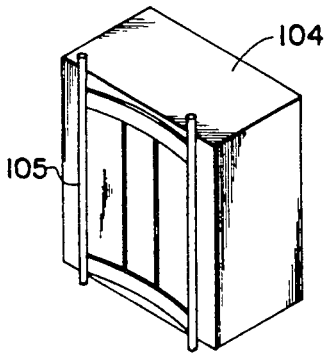
FIG. 5B is an isometric view of a backpack apparatus for carrying the case of FIG. 5A.

Between uses, descent device 10 may be stored in a case 104, as shown in FIG. 5A. When the device is removed from the building, helicopter or other structure, the individual segments 19 of guide assembly 12 are separated and the four cable strands 28 are folded, such as in the rectangular pattern shown in FIG. 5A, so that the individual segments are arranged to follow that pattern. A plurality of carriages 36 are stored between the folded guide assembly 12. As shown in FIG. 5B, case 104 may be mounted to a backpack frame 105 so that rescue personnel can carry the descent device to the floor of a building from which escape is required. Alternatively, military personnel can conveniently transport the descent device to and from a helicopter or other aircraft.

Figure 6:
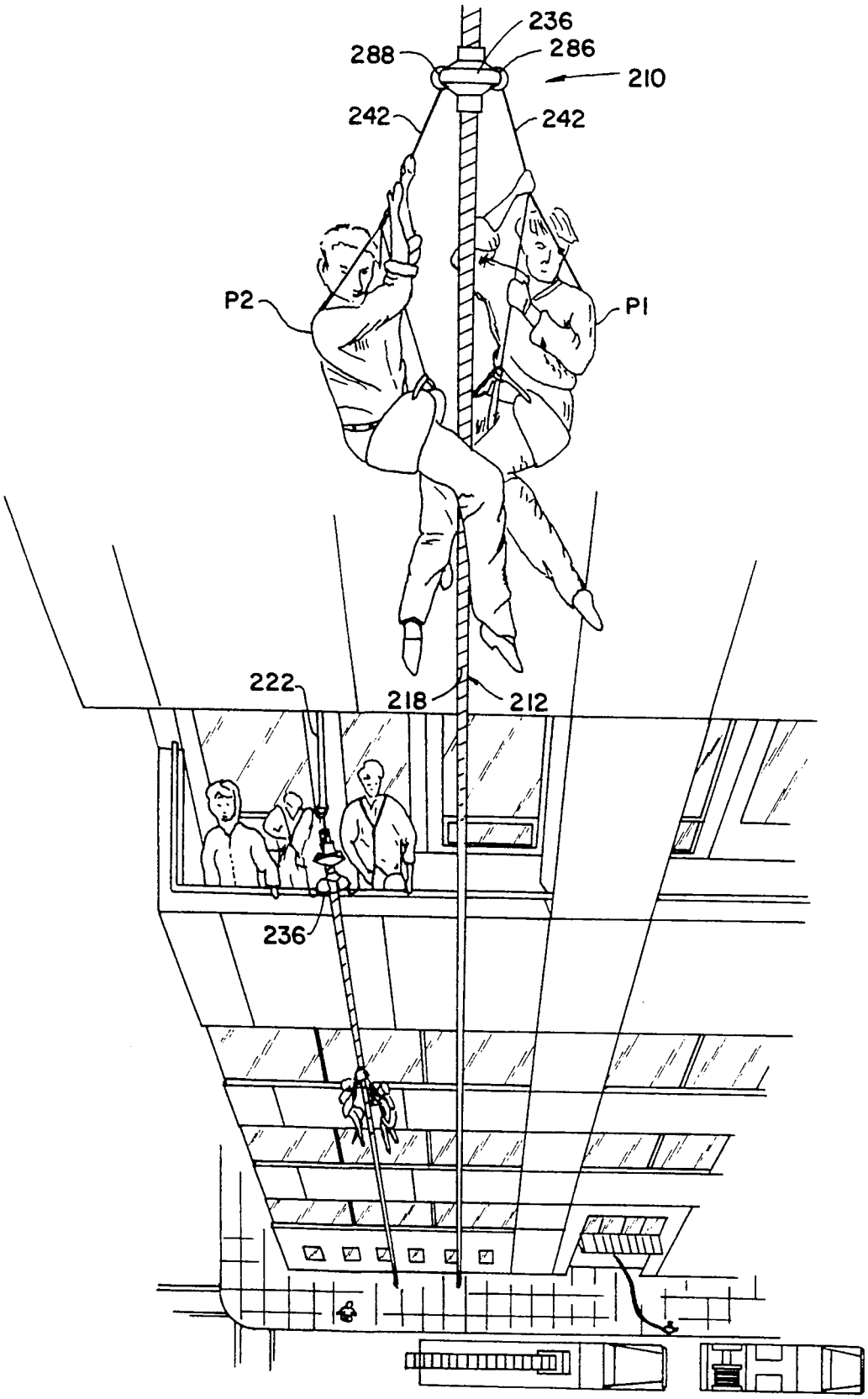
FIG. 6 is a perspective view of the descent device in operation.

As shown in FIG. 6, an alternative device 210 according to this invention employs a carriage 236 which supports two persons P1 and P2. A separate harness 242 is engaged with each hitching element 286 and 288. In all other respects this embodiment is constructed and operates analogously to the previously described embodiment. A guide assembly 212 is held by a support 222 so that persons may descend from various levels of building B1. Note also that multiple carriages 236 may be employed for each guide assembly.

Again, the carriage 236 descends along a track 218 and the two part carriage operates to maintain the passengers in a constant direction. It should be noted, however, that this invention is not limited to a two part carriage. In alternative embodiments, a one piece or rotating carriage may be employed.

Figure 7:
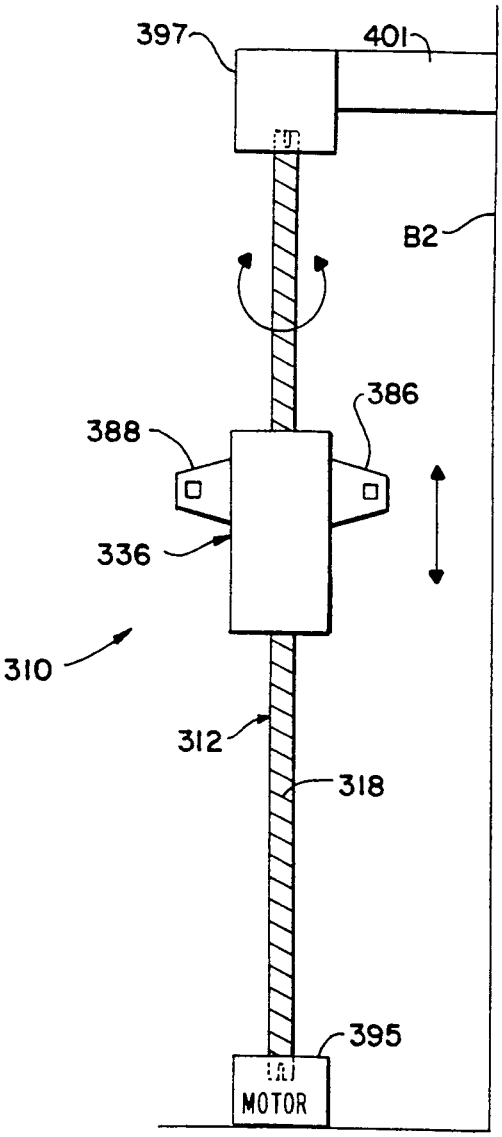
FIG. 7 is an elevational, partially schematic view of a motorized ascent/descent device in accordance with this invention.

In still another embodiment, FIG. 7, a motorized ascent/descent device 310 may be employed. Device 310 includes an elongate guide assembly 312 having a helical track 318. A carriage 336 is mounted for longitudinal movement up and down track 318. The track and carriage structure may be similar to that previously described. The lower (or alternatively upper) end of assembly 312 is keyed for operable engagement with a conventional rotary motor 395. The upper end of guide assembly 312 is rotatably supported by a conventional bearing 397 that is itself mounted to a building B2 by means of a support 401. Motor 395 may be powered, for example, by the battery of a fire truck or emergency vehicle.

In operation, a harness, not shown, is engaged with hitching elements 386 and 388 as previously described. The motor 395 is then operated in a first direction so that carriage 336 travels along track 318 from an upper end of the guide assembly to the lower end. Alternatively, ascent along the guide assembly is accomplished by reversing the direction of the motor. This causes the carriage to ascend track 318, thereby elevating persons from the lower end of guide assembly 312 to the upper end thereof.

Figure 8:
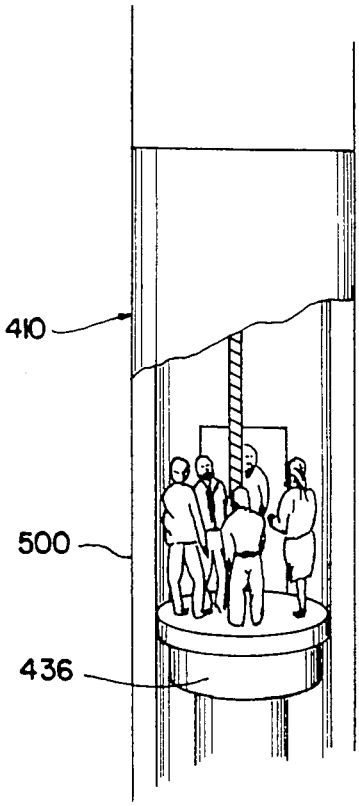
FIG. 8 is a perspective view of an elevator that employs the principles of the device of FIG. 7.

As shown in FIG. 8, the above structure may be modified somewhat for use as an elevator 410. Carriage 436 comprises a platform for supporting a number of persons. The entire device 410 may be enclosed within a column 500.

The ascent/descent device described above is not limited to use with high rise buildings and may also be used in applications such as helicopters.

Figure 9:
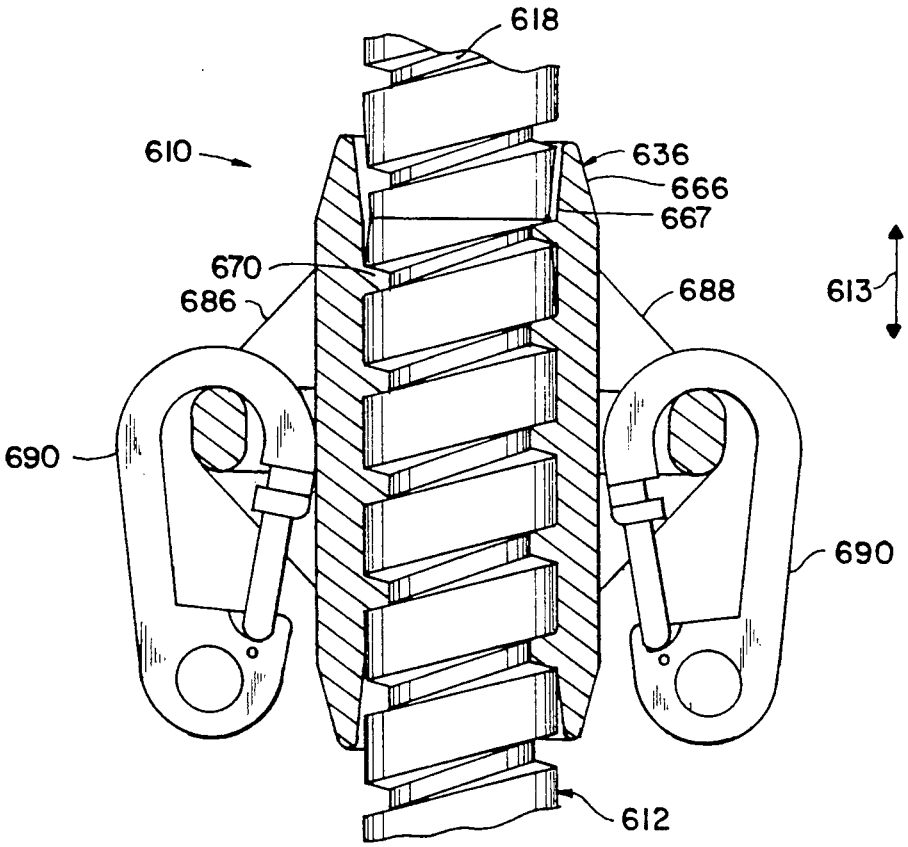
FIG. 9 is an elevational, partly cut away view of an alternative descent device according to this invention.
Figure 10:
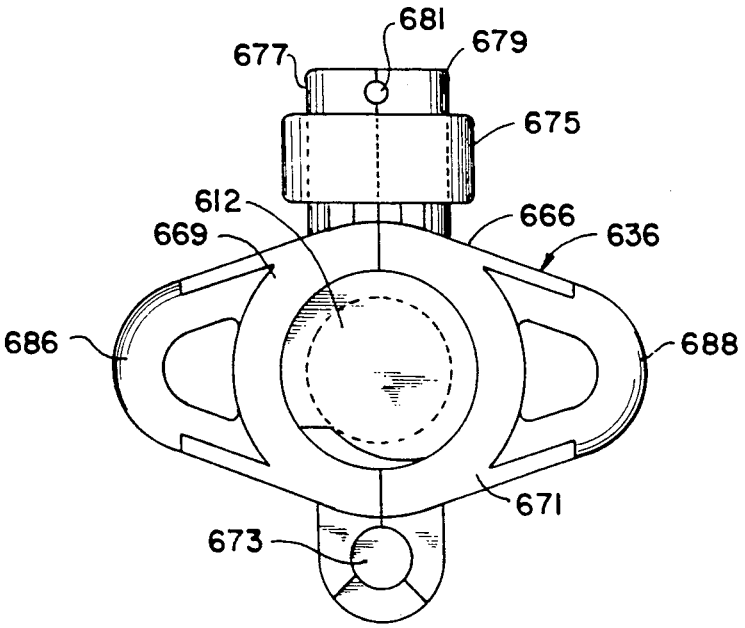
FIG. 10 is a top view of the carriage of FIG. 9.

In an alternative embodiment, FIGS. 9 and 10, descent device 610 employs an elongate guide assembly 612, only a portion of which is shown. Guide assembly 612 is constructed in a manner analogous to the guide assembly described in the previous embodiment. More particularly, guide assembly 612 includes an elongate helical track 618 that extends generally longitudinally from an upper portion to a lower portion of the guide assembly. A carriage 636 is mounted for longitudinal travel along guide assembly 618. Carriage 636 includes an element 666 that surrounds guide assembly 612 and includes a central opening 667. A helical thread 670 is formed along the inside wall of opening 667. Thread 670 engages the helical track 618 and is slidable therein so that carriage 636 travels along track 618 rotatably about guide assembly 612 and up and down the guide assembly in the direction of double-headed arrow 613.

Carriage 636 includes hitching elements 686 and 688 similar to those described in the previous embodiment. Clamps 690 are likewise engaged with the hitching elements so that a person may be mounted by means of a harness to the carriage.

The carriage comprises a split ring construction, as shown most clearly in FIG. 10. In particular, element 666 includes a half portion 669 that carries hitching element 686 and a half portion 671 that carries hitching element 688. Half portions 669 and 671 are hingedly connected by a pivot 673. Portions 669 and 671 are selectively closed together about guide assembly 612. Closed parts 669 and 671 are held together by a clamp 675 which engages respective arms 677 and 679 of portions 669 and 671. A safety pin 681 prevents clamp 675 from slipping off of arms 677 and 679.

In operation, guide assembly 612 and a number of carriages 636 may be transported to the site of an emergency with the carriages disengaged from the guide assembly. Guide assembly 612 is then secured to the building, helicopter or other height as previously described and one or more carriages 636 are pivotably opened and engaged about the guide assembly. Each carriage 636 is then secured closed as shown in FIG. 10. A harness attachment is secured to each hitching element and a person in the harness lowers himself down the guide assembly 612. As the carriage 636 travels along track 618 it rotates about the guide assembly so that the person in the harness likewise rotates. As each carriage reaches the bottom of the guide assembly, pin 681 and clamp 675 may be removed and the portions 669 and 671 may be pivoted open to remove the carriage from the guide assembly. The carriage may then be stored or engaged with another guide assembly suspended to a lower level.

Although specific features of the invention are shown in some of the drawings and not others, this is for convenience only as each feature may be combined with any and all of the other features in accordance with this invention.

Other embodiments will occur to those skilled in the art and are within the following claims.

What is claimed is:

1. A controlled descent device comprising:

an elongate guide assembly that includes an upper portion, a lower portion, and a generally stationary helical track which is disposed peripherally about said guide assembly and extends from the upper portion to the lower portion;

a carriage, which includes primary bearing means that are movably engaged with said track such that at least a portion of said carriage is movable in a generally helical pattern about said guide; and means for securing a harness to said carriage, said carriage being freely descendible along said track to lower a person fastened in said harness from said upper portion of said guide assembly to said lower portion thereof.

2. The device of claim 1 in which said guide assembly includes a plurality of alignable track segments and means for interengaging adjacent said track segments in an end to end arrangement.

3. The device of claim 2 in which said means for interengaging adjacent segments include key means in one end of one said segments and complementary keyway means in the opposite end of said adjacent segment for receiving said key means.

4. The device of claim 3 in which said key means and said keyway means include complementary, generally cross-like shapes.

5. The device of claim 1 in which said guide assembly includes cable means extending longitudinally therethrough such that said helical track generally winds about said cable means.

6. The device of claim 5 in which said guide assembly includes channel means formed longitudinally therethrough for accommodating said cable means.

7. The device of claim 1 further including stop means connected to said guide assembly proximate said lower portion to limit descent of said carriage along said guide assembly.

8. The device of claim 1 further including means proximate said upper portion for securing said guide assembly to a fixed structure.

9. The device of claim 1 in which said carriage includes an inner part that carries said primary bearing means and an outer part that is rotatably mounted to said inner part for carrying said means for securing.

10. The device of claim 9 in which said carriage means include secondary bearing means for rotatably interconnecting said inner and outer parts.

11. The device of claim 1 in which said primary bearing means include thread means formed along an inner surface of said carriage.

12. The device of claim 1 in which said primary bearing means include ball bearings enclosed by said carriage and received by said track.

13. The device of claim 1 in which said means for securing includes at least one hitching element fixed to said carriage and a complementary hook element that is attached to said harness and is selectively engagable with said hitching element to secure said harness to said carriage.

14. The device of claim 1 in which said carriage includes a pair of hingedly interconnected carriage portions, which are selectively closed to generally surround said guide and opened to remove said carriage from said guide.

15. The device of claim 14 further including means for provisionally locking said carriage portions in a closed condition around said guide.

16. The device of claim 1 in which said guide assembly is composed substantially entirely of plastic.

17. The device of claim 1 in which said carriage is composed substantially entirely of plastic.

18. A controlled descent device comprising:

an elongate guide assembly that includes an upper portion, a lower portion, and a generally helical track which extends from the upper portion to the lower portion;

a generally annular carriage, which includes hingedly interconnected first and second carriage portions for generally surrounding said guide and primary bearing means that are carried by said carriage portions for engaging and moving within said track; said first and second carriage portions being selectively opened to remove said carriage from around said guide; and means for securing a harness to said carriage, said carriage being descendible along said track to lower a person fastened in said harness from said upper portion of said guide assembly to said lower portion thereof.

* * * * *